United States Patent [19]

Simon et al.

[11] 4,274,927

[45] Jun. 23, 1981

[54] PROCESS FOR THE ELECTROLYTIC DEPOSITION OF GOLD AND GOLD ALLOY COATINGS AND COMPOSITIONS THEREFORE

[75] Inventors: Franz Simon, Schmitten; Wolfgang Zilske, Hanau; Manfred Schmidt, Rodenbach, all of Fed. Rep. of Germany

[73] Assignee: Degussa Aktiengesellschaft, Frankfurt, Fed. Rep. of Germany

[21] Appl. No.: 135,766

[22] Filed: Mar. 31, 1980

[30] Foreign Application Priority Data

Apr. 12, 1979 [DE] Fed. Rep. of Germany ..... 2914879

[51] Int. Cl.[3] ..... C25D 3/66

[52] U.S. Cl. ..... 204/39

[58] Field of Search ..... 204/39, 64 R, 71

[56] References Cited

U.S. PATENT DOCUMENTS 4,149,942 4/1979 von Stutterheim ..... 204/39 X

*Primary Examiner*—G. L. Kaplan

*Attorney, Agent, or Firm*—Cushman, Darby & Cushman

[57] ABSTRACT

For the electrolytic deposition of gold alloys there is required a process with which low carat coatings can be deposited which nevertheless have a high resistance to tarnish. Such coatings are obtained from electrolytes which consist of a salt melt and contain gold salts, alkali thiocyanate and salts of one or more alloyings elements as constituents. Preferably the electrolyte contains per liter of salt melt 0.5 to 20 grams of gold, up to 300 grams of Cu, Zn, Sn, Cd, Ni, Ag, Pd, Ru and/or Pt, up to 200 grams of alkali cyanide and/or water.

24 Claims, No Drawings

PROCESS FOR THE ELECTROLYTIC DEPOSITION OF GOLD AND GOLD ALLOY COATINGS AND COMPOSITIONS THEREFORE

BACKGROUND OF THE INVENTION

The invention is directed to a composition and process for the electrolytic deposition of gold and gold alloy coatings out of an electrolyte that contains or consists of a salt melt.

Gold and gold alloy coatings are in use in many areas of the art in order to enable objects or to protect them from the influence of corrosion. Gold and gold alloy coatings are used especially for electrical contacts in the low-voltage current art and in the semi-conductor industry. In the previously customary wet galvanic process indeed only high carat gold coatings guarantee a sufficient resistance to tarnish and therewih a constant low electric resistance of the contacts to the passage of current.

Because of the high price of gold, for industrial uses for reasons of economy it would be desirable to employ low carat gold alloy coatings which would have to be the equal of the high carat coatings in regard to their resistance to tarnish.

Such wet galvanic depositing low carat gold alloy coatings (<20 carats) however, are for the most part not equal to the high requirements in industrial use. The reasons for the lack of tarnish resistance of these coatings probably is due to the fact that the deposits are heterogeneous and under these conditions of operation there are only partially built mixed crystals from the alloy components, which alone would guarantee a sufficient resistance to tarnishing.

Therefore it was the problem of the present invention to develop a process for the electrolytic deposition of gold and gold alloy coatings with which low carat gold coatings also permit the production of low carat gold coatings having higher resistance to tarnishing in air or other medium.

SUMMARY OF THE INVENTION

This problem was solved according to the invention by providing an electrolyte which comprises or consists of a salt melt which contains a gold salt, alkali thiocyanate and in a given case a salt of one or more alloying metals.

Preferably the electrolyte contains 0.5–20 grams of gold per liter of salt melt in the form of a thiocyanate, cyano and/or chloro compounds of mono or trivalent gold, e.g. gold (I) chloride, gold (III) chloride, gold (I) cyanide, gold (III) cyanide, gold (I) bromide, gold (III) bromide, gold (I) thiocyanate and gold (III) thiocyanate. Particularly proven good are baths containing 5 to 15 grams of gold per liter of salt melt.

As alkali thiocyanate there is advantageously used a mixture of 70 mol % potassium thiocyanate and 30 mol % sodium thiocyanate having a melting point of about 125° C. However, there can also be used other mixture ratios and other thiocyanate components for the process of the invention. There can also be used sodium thiocyanate or potassium thiocyanate individually.

It has proven especially advantageous if there is added to the electrolyte up to 200 grams of alkali cyanide, e.g. sodium cyanide or potassium cyanide, per liter or salt melt and/or up to 200 ml of water per liter of salt melt. Thus when alkali cyanide is present it is usually present in an amount of at least 20 grams per liter of salt melt. Likewise when water is present, it is usually present in an amount of at least 20 grams per liter of salt melt.

As alloying metals there are usuable silver, palladium, ruthenium, platinum as well as copper, zinc, cadmium, nickel and tin in amounts up to 300 grams, particularly in amounts of 5 to 280 grams per liter of salt melt in the form of a salt soluble in the melt. Particularly recommended are the thiocyanate, chloro, sulfato and/or cyano compounds of these metals, e.g. compounds such as silver cyanide, silver thiocyanate, silver chloride or silver sulfate, palladium chloride, palladium cyanide, ruthenium cyanide, platinum (II) cyanide, platinum (II) sulfate, Platinum (II) chloride, copper (I) cyanide, copper (II) cyanide, copper (I) chloride, copper (II) chloride, zinc chloride, zinc cyanide, cadmium sulfate, nickel (II) chloride, nickel cyanide, cadmium cyanide, cadmium sulfate, tin (II) chloride, tin (IV) chloride. Tin is preferably added as the hexahydroxy stannates, e.g. sodium hexahydroxy stannate.

The deposition takes place preferably at temperatures of 100° to 200° C., especially at 150° C. Advantageously there are employed hereby insoluble anodes e.g. carbon or platimited titanium.

With the process of the invention there can be deposited low carat gold coatings (i.e. below 20 carats) of e.g. 18 or 16 (or even 14) carat which are equal to pure gold or high carat gold alloy coatings in their tarnish and corrosion resistance. X-ray examinations on the thus produced gold alloy coatings show that the structure is substantially homogeneous and a mixed crystal formation has occurred. Corrosion tests as well as measurements of electric current resistance prove that these low carat gold alloy coatings have a high tarnish resistance.

Besides low carat gold alloy coating naturally there can also be deposited according to the process of the invention pure gold and high carat gold coatings.

Unless otherwise indicated all parts and percentages are by weight.

The compositions can comprise, consist essentially of or consist of the material set forth and the process can comprise, consist essentially of or consist of the steps set forth with said materials.

The following examples further describe the process of the invention.

DESCRIPTION OF THE PREFERRED EMBODIMENTS

EXAMPLE 1

1 kg of a mixture of KSCN and NaSCN (70:30 mole %) was melted and brought to a temperature of 150° C. Subsequently there were added 100 ml of water, 100 grams of KCN, 50 grams of copper as copper (I) cyanide and 5 grams of gold as $K[Au(CN)_2]$. At a current density of 0.6 $A/dm^2$ there deposited on a nickel under layer an 18 carat gold-copper-alloy coating which was distinguished by a high tarnish resistance. By variations of the current density as is known in the art the carat content of the coatings can be changed. As an insoluble anode platimated titanium is used.

EXAMPLE 2

There were added to 1 kg of a mixture of KSCN and NaSCN according to Example 1 (70:30 mole %) 80 ml of water, 100 grams of KCN, 4 grams of gold as $KAu(CN)_2$, 50 grams of copper as copper (I) cyanide 60 grams of palladium as $K_2Pd(CN)_4$. At a temperature of 160° C. and a current density of 0.3 A/dm$^2$ there was obtained an 18 carat gold alloy coating and at a current density of 0.6 A/dm$^2$ there was obtained a 16 carat coating. Both coatings showed a high resistance to stain.

The entire disclosure of German priority application P 29 14 879.6 is hereby incorporated by reference. As insoluble anode platimited titanium is used.

What is claimed is:

1. A composition suitable for the electrolytic deposition of gold or a gold base alloy comprising an electrolyte which is a salt melt bath and consists essentially of a gold salt and an alkali metal thiocyanate or a mixture of a gold salt, alkali metal thiocyanate and a salt of at least one metal forming an alloy with gold and which salt melt bath contains water in an amount of 20 to 200 ml per liter of melt.

2. A composition according to claim 1 wherein the electrolyte contain 0.5 to 20 grams of gold per liter of salt melt, the gold being present as mono or trivalent gold as a thiocyanato, cyano or chloro gold compound or as a mixture thereof.

3. A composition according to claim 2 wherein the electrolyte contains 5–15 grams of gold per liter of salt melt.

4. A composition according to claim 2 wherein the alkali metal thiocyanate is present as a mixture of 70 mole % potassium thiocyanate and 30 mole % of sodium thiocyanate.

5. A composition according to claim 2 wherein alkali metal cyanide is also present and is present in an amount up to 200 grams of alkali cyanide per liter of melt.

6. A composition according to claim 5 wherein the water is present in an amount of 80 to 100 ml of water per kilogram of alkali metal thiocyanate.

7. A composition according to claim 2 wherein the water is present in an amount of 80 to 100 ml of water per kilogram of alkali metal thiocyanate.

8. A composition according to claim 2 wherein there is present in the salt melt a soluble salt of copper, zinc, cadmium, nickel, tin, silver, palladium, ruthenium or platinum, said soluble salt being present in an amount of up to 300 grams per liter of salt melt.

9. A composition according to claim 8 wherein the water is present in an amount of 80 to 100 ml per kilogram of alkali metal thiocyanate.

10. A composition according to claim 8 wherein the soluble salt is present in an amount of 5 to 280 grams per liter salt melt.

11. A composition according to claim 10 wherein the soluble salt is a thiocyanate, chloride, sulfate or cyano compound.

12. In a process of electrolytically depositing gold or a gold base alloy coating the improvement comprising employing as the electrolyte the composition of claim 1.

13. In a process of electrolytically depositing gold or a gold base alloy coating the improvement comprising employing as the electrolyte the composition of claim 2.

14. In a process of electrolytically depositing gold or a gold base alloy coating the improvement comprising employing as the electrolyte the composition of claim 3.

15. In a process of electrolytically depositing gold or a gold base alloy coating the improvement comprising employing as the electrolyte the composition of claim 4.

16. In a process of electrolytically depositing gold or a gold base alloy coating the improvement comprising employing as the electrolyte the composition of claim 5.

17. In a process of electrolytically depositing gold or a gold base alloy coating, the improvement comprising employing as the electrolyte the composition of claim 6.

18. In a process of electrolytically depositing gold or a gold base alloy coating, the improvement comprising employing as the electrolyte the composition of claim 7.

19. In a process of electrolytically depositing gold or a gold base alloy coating, the improvement comprising employing as the electrolyte the composition of claim 8.

20. In a process of electrolytically depositing a gold or a gold base alloy coating, the improvement comprising employing as the electrolyte the composition of claim 9.

21. In a process of electrolytically depositing gold or a gold base alloy coating, the improvement comprising employing as the electrolyte the composition of claim 10.

22. In a process of electrolytically depositing gold or a gold base alloy coating, the improvement comprising employing as the electrolyte the composition of claim 11.

23. In a process of electrolytically depositing gold or a gold base alloy coating, the improvement comprising employing as the electrolyte the composition of claim 11 and the process is carried out at 100° to 200° C.

24. In a process of electrolytically depositing a gold or gold base alloy coating, the improvement comprising employing as the electrolyte the composition of claim 2 and the process is carried out at 100° to 200° C.

* * * * *